US008802605B2

(12) United States Patent
Rabbat et al.

(10) Patent No.: US 8,802,605 B2
(45) **Date of Patent: *Aug. 12, 2014**

(54) LUBRICANT COMPOSITION

(75) Inventors: Philippe Marc André Rabbat, New York, NY (US); Ryan James Fenton, Norwalk, CT (US); David Eliezer Chasan, Teaneck, NJ (US); Kevin J. DeSantis, Upper Nyack, NY (US)

(73) Assignee: BASF SE, Ludwigshafen (DE)

( * ) Notice: Subject to any disclaimer, the term of this patent is extended or adjusted under 35 U.S.C. 154(b) by 269 days.

This patent is subject to a terminal disclaimer.

(21) Appl. No.: 12/852,147

(22) Filed: Aug. 6, 2010

(65) Prior Publication Data

US 2011/0034359 A1 Feb. 10, 2011

Related U.S. Application Data

(60) Provisional application No. 61/232,060, filed on Aug. 7, 2009.

(51) Int. Cl.
*C10M 145/04* (2006.01)

(52) U.S. Cl.
USPC ..... 508/517; 508/100

(58) Field of Classification Search
USPC ..... 508/517
See application file for complete search history.

(56) References Cited

U.S. PATENT DOCUMENTS

| | | | |
|---|---|---|---|
| 2,010,154 | A | 8/1935 | Hubacher et al. |
| 2,653,972 | A | 9/1953 | Ash et al. |
| 2,745,857 | A | 5/1956 | Britton et al. |
| 2,801,972 | A | 8/1957 | Bartlett et al. |
| 2,803,646 | A | 8/1957 | Bell et al. |
| 3,625,893 | A | 12/1971 | Brook et al. |
| 3,755,176 | A | 8/1973 | Kinney et al. |
| 3,791,971 | A | 2/1974 | Lowe et al. |
| 3,828,086 | A | 8/1974 | Kenney et al. |
| 3,856,688 | A | 12/1974 | Kenney et al. |
| 3,890,381 | A | 6/1975 | Kiyoura et al. |
| 3,956,382 | A | 5/1976 | Krause |
| 3,992,443 | A | 11/1976 | Springmann |
| 4,088,590 | A | 5/1978 | Knoblauch et al. |
| 4,098,818 | A | 7/1978 | Krummel et al. |
| 4,214,101 | A | 7/1980 | Miya et al. |
| 4,265,774 | A | 5/1981 | Langdon |
| 4,579,672 | A | 4/1986 | Brecker et al. |
| 4,625,057 | A | 11/1986 | Springmann et al. |
| 4,713,487 | A | 12/1987 | Sekine et al. |
| 4,719,052 | A | 1/1988 | Ohsaka et al. |
| 4,784,781 | A | 11/1988 | Denis et al. |
| 4,898,687 | A | 2/1990 | Parker et al. |
| 4,954,273 | A | 9/1990 | Denis et al. |
| 4,976,893 | A | 12/1990 | Leupold |
| 4,978,785 | A | 12/1990 | Sanderson et al. |
| 5,013,482 | A | 5/1991 | O'Neil |
| 5,223,642 | A | 6/1993 | Schonwalder |
| 5,230,823 | A | 7/1993 | Wise et al. |
| 5,233,087 | A | 8/1993 | Cripe |
| 5,250,203 | A | 10/1993 | Denis et al. |
| 5,263,308 | A | 11/1993 | Lee et al. |
| 5,275,809 | A | 1/1994 | Chen et al. |
| 5,282,987 | A | 2/1994 | Balzer et al. |
| 5,292,940 | A | 3/1994 | Carduck et al. |
| 5,296,218 | A | 3/1994 | Chen et al. |
| 5,368,761 | A | 11/1994 | Gore et al. |
| 5,374,366 | A | 12/1994 | Nakahara et al. |
| 5,412,049 | A | 5/1995 | Argyropoulos et al. |
| 5,440,000 | A | 8/1995 | Shirodkar et al. |
| 5,463,114 | A | 10/1995 | Noack et al. |
| 5,490,950 | A | 2/1996 | Smid et al. |
| 5,516,440 | A | 5/1996 | Dasai et al. |

(Continued)

FOREIGN PATENT DOCUMENTS

| | | | |
|---|---|---|---|
| CN | 101437931 | A | 5/2009 |
| DE | 2418444 | A1 | 4/1974 |

(Continued)

OTHER PUBLICATIONS

English language abstract for JP 2097593 extracted from espacenet.com database, dated Dec. 14, 2010, 6 pages.
English language abstract for JP 2097592 extracted from espacenet.com database, dated Dec. 14, 2010, 6 pages.
English language abstract for JP 2002275483 extracted from espacenet.com database, dated Dec. 14, 2010, 8 pages.
"Alcohols, Aliphatic" Falbe, J., Bahrmann, H., Lipps, W. and Mayer, D. 2000. Alcohols, Aliphatic. Ullmann's Encyclopedia of Industrial Chemistry, 27 pages.
Technical Paper, "New Generation of Ashless Top Tier Hydraulic Fluids", Lubrication Engineering, Clark, et al., Apr. 2000,10 pages.
"Fatty Alcohols", Noweck, et al.,Ullmann's Encyclopedia of Industrial Chemistry, 2006, 26 pages.

(Continued)

*Primary Examiner* — Vishal Vasisth
(74) *Attorney, Agent, or Firm* — Howard & Howard Attorneys PLLC

(57) ABSTRACT

A lubricant composition includes a base oil and one or more alkylethercarboxylic acid corrosion inhibitor(s) having the formula;

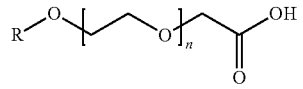

In this formula, R is a straight or branched chain C6-C18 alkyl group and n is a number of from 0 to 5. The lubricant composition can be utilized in a method for reducing corrosion of a steel article. The method includes the steps of providing the base oil and providing the one or more alkylethercarboxylic acid corrosion inhibitor(s). The method also includes the step of combining the base oil and the one or more alkylethercarboxylic acid corrosion inhibitor(s) to form the lubricant composition including less than about 0.1 weight percent of the one or more alkylethercarboxylic acid corrosion inhibitor(s). The method further includes the step of applying the lubricant composition to the steel article wherein the steel article passes corrosion testing according to ASTM D 665 B.

26 Claims, No Drawings

(56) References Cited

U.S. PATENT DOCUMENTS

| | | | | |
|---|---|---|---|---|
| 5,576,470 | A | 11/1996 | Tuller et al. | |
| 5,597,871 | A | 1/1997 | Auschra et al. | |
| 5,609,862 | A | 3/1997 | Chen et al. | |
| 5,773,505 | A | 6/1998 | Pennewiss et al. | |
| 5,843,874 | A | 12/1998 | Macpherson et al. | |
| 5,863,999 | A | 1/1999 | Kinker et al. | |
| 5,955,405 | A | 9/1999 | Liesen et al. | |
| 5,969,068 | A | 10/1999 | Bryant et al. | |
| 6,034,040 | A | 3/2000 | Ozbalik et al. | |
| 6,063,146 | A | 5/2000 | Miller et al. | |
| 6,133,210 | A | 10/2000 | Tipton | |
| 6,140,431 | A | 10/2000 | Kinker et al. | |
| 6,255,261 | B1 | 7/2001 | Liesen et al. | |
| 6,290,869 | B1 | 9/2001 | Sorensen et al. | |
| 6,291,409 | B1 * | 9/2001 | Kodali et al. | 508/491 |
| 6,294,628 | B1 | 9/2001 | Bryant et al. | |
| 6,323,164 | B1 | 11/2001 | Liesen et al. | |
| 6,326,514 | B1 | 12/2001 | Klug et al. | |
| 6,348,554 | B1 | 2/2002 | Roos et al. | |
| 6,391,996 | B1 | 5/2002 | Scherer et al. | |
| 6,403,745 | B1 | 6/2002 | Scherer et al. | |
| 6,403,746 | B1 | 6/2002 | Roos et al. | |
| 6,458,749 | B2 | 10/2002 | Kinker et al. | |
| 6,511,946 | B1 | 1/2003 | Theis et al. | |
| 6,525,006 | B2 | 2/2003 | Yoneta et al. | |
| 6,569,969 | B2 | 5/2003 | Charmot et al. | |
| 6,586,375 | B1 | 7/2003 | Gahagan et al. | |
| 6,610,801 | B1 | 8/2003 | Scherer | |
| 6,610,802 | B2 | 8/2003 | Roos et al. | |
| 6,627,584 | B2 | 9/2003 | Ozbalik | |
| 6,712,991 | B2 | 3/2004 | Gore et al. | |
| 6,780,824 | B2 | 8/2004 | Oelscher et al. | |
| 6,787,663 | B2 | 9/2004 | Adams et al. | |
| 6,803,050 | B2 | 10/2004 | Denzer et al. | |
| 6,881,780 | B2 | 4/2005 | Bryant et al. | |
| 7,008,561 | B2 | 3/2006 | Dahlmann et al. | |
| 7,189,682 | B2 | 3/2007 | Gapinski | |
| 7,208,118 | B2 | 4/2007 | Leinweber et al. | |
| 7,214,276 | B2 | 5/2007 | Dahlmann et al. | |
| 7,429,555 | B2 | 9/2008 | Scherer | |
| 7,470,381 | B2 | 12/2008 | Placek et al. | |
| 7,553,673 | B2 | 6/2009 | Kinker et al. | |
| 7,560,420 | B2 | 7/2009 | Kinker et al. | |
| 7,615,522 | B2 | 11/2009 | Camenzind et al. | |
| 7,645,842 | B2 | 1/2010 | Acker et al. | |
| 7,648,950 | B2 | 1/2010 | Placek et al. | |
| 7,851,420 | B2 | 12/2010 | Theunissen et al. | |
| 7,875,581 | B2 | 1/2011 | Chiba et al. | |
| 8,343,905 | B2 | 1/2013 | Gutierrez et al. | |
| 2003/0194388 | A1 | 10/2003 | Dahlmann et al. | |
| 2004/0014611 | A1 * | 1/2004 | Li | 508/214 |
| 2004/0014879 | A1 | 1/2004 | Denzer et al. | |
| 2004/0235680 | A1 | 11/2004 | Lawrence et al. | |
| 2005/0262643 | A1 | 12/2005 | Nogues Lopez et al. | |
| 2005/0288191 | A1 | 12/2005 | Lawrence et al. | |
| 2007/0184202 | A1 | 8/2007 | Rochfort et al. | |
| 2007/0197407 | A1 | 8/2007 | Bardasz et al. | |
| 2008/0076687 | A1 | 3/2008 | Habeeb et al. | |
| 2009/0017243 | A1 * | 1/2009 | Person Hei et al. | 428/35.7 |
| 2010/0009879 | A1 | 1/2010 | Theyssen et al. | |
| 2010/0081716 | A1 | 4/2010 | Matsunaga et al. | |
| 2010/0130392 | A1 | 5/2010 | Theyssen et al. | |
| 2010/0286009 | A1 | 11/2010 | Vierbaum et al. | |
| 2011/0034359 | A1 | 2/2011 | Rabbat et al. | |

FOREIGN PATENT DOCUMENTS

| | | | |
|---|---|---|---|
| DE | 4244536 | A1 | 7/1994 |
| DE | 19730085 | A1 | 1/1999 |
| DE | 19747895 | A1 | 5/1999 |
| DE | 19833894 | A1 | 2/2000 |
| DE | 19956237 | A1 | 5/2001 |
| EP | 0399751 | A2 | 5/1990 |
| EP | 0566956 | A1 | 10/1993 |
| EP | 1652909 | A1 | 5/2006 |
| EP | 2042587 | A1 | 4/2009 |
| EP | 2050806 | A1 | 4/2009 |
| JP | 2097592 | A | 4/1990 |
| JP | 2097593 | A | 4/1990 |
| JP | 08333592 | | 12/1996 |
| JP | 09040982 | | 2/1997 |
| JP | 09040990 | | 2/1997 |
| JP | 11199881 | | 7/1999 |
| JP | 2001335696 | | 12/2001 |
| JP | 2002212007 | | 7/2002 |
| JP | 2002275483 | A | 9/2002 |
| JP | 2005247850 | A | 9/2005 |
| JP | 2008031149 | | 2/2008 |
| JP | 2008106253 | | 5/2008 |
| JP | 2009096997 | | 5/2009 |
| JP | 2009-197338 | | 9/2009 |
| JP | 2009197338 | | 9/2009 |
| PL | 314357 | | 11/1996 |
| PL | 182003 | B1 | 10/2001 |
| WO | WO 9856881 | A1 | 12/1998 |
| WO | WO 2004037960 | A1 | 5/2004 |
| WO | 2008073951 | A1 | 6/2008 |
| ZA | 9809884 | | 4/1999 |

OTHER PUBLICATIONS

PCT International Search Report, Application No. PCT/US2010/044747, dated Nov. 19, 2010, 3 pages.

Appendix E—"API Base Oil Interchangeability Guidelines for Passenger Car Motor Oils and Diesel Engine Oils" API 1509, Engine Oil Licensing and Certification System, 16th Edition, Apr. 2007, 26 pages.

English language abstract for DE 19956237 extracted from espacenet.com database, dated Jan. 5, 2011, 9 pages.

English language abstract for DE 19833894 extracted from espacenet.com database, dated Jan. 5, 2011, 7 pages.

Article; Betty Burke, et al, Journal of ASTM International "Contamination of Power Generationtion Lubricants", vol. 4, No. 10, Nov. 2007, available 333 online at www.sstem .org., 7 pages.

Article; D. Clark, et al., "New Generation of Ashless Top Tier Hydraulic Fluids/North America", not dated, printed off the website on Jan. 14, 2011, 10 pages.

English equivalent for DE 24 18 444 extracted from espacenet.com on Jan. 24, 2011, 23 pages.

English language abstract and translation for DE 19956237 extracted from the espacenet.com database, 16 pages.

English language abstract and translation for JP 2009-197338 extracted from the PAJ database, 43 pages.

English language abstract for DE 4244536 extracted from the espacenet.com database on Aug. 17, 2011, 7 pages.

English language abstract for DE 19730085 extracted from the espacenet.com database on Aug. 18, 2011, 5 pages.

English language abstract for DE 19747895 extracted from the espacenet.com database on Aug. 17, 2011, 27 pages.

English language abstract for EP 0566956 extracted from the espacenet.com database on Aug. 17, 2011, 9 pages.

English language abstract for EP 2050806 extracted from the espacenet.com database on Aug. 17, 2011, 11 pages.

English language abstract and translation for JP 08333592 extracted from the PAJ database on Aug. 17, 2011, 18 pages.

English language abstract and translation for JP 09040982 extracted from the PAJ database on Aug. 17, 2011, 25 pages.

English language abstract and translation for JP 09040990 extracted from the PAJ database on Aug. 17, 2011, 25 pages.

English language abstract and translation for 11199881 extracted from the PAJ database on Aug. 17, 2011, 33 pages.

English language abstract and translation for JP 2001335696 extracted from the PAJ database on Aug. 17, 2011, 23 pages.

English language abstract and translation for JP 2002212007 extracted from the PAJ database on Aug. 17, 2011, 26 pages.

English language abstract and translation for JP 2008106253 extracted from the PAJ database on Aug. 17, 2011, 49 pages.

(56) References Cited

OTHER PUBLICATIONS

English language abstract and translation for JP 2008031149 extracted from the PAJ database on Aug. 17, 2011, 150 pages.
English language abstract and translation for JP 2009096997 extracted from the PAJ database on Aug. 17, 2011, 138 pages.
English language abstract and translation for JP 2009197338 extracted from the PAJ database on Aug. 17, 2011, 56 pages.
English language abstract for PL 314357. Original document not available. However, see foreign language equivalent PL 182003, 10 pages.
Zhao et al., "Oxidation of Primary Alcohols to Carboxylic Acids with Sodium Chlorite Catalyzed by Tempo and Bleach: 4-Methoxyphenylacetic Acid," Organic Synthesis, 2005, vol. 81, p. 195-203.
English language abstract for EP 1652909 extracted from the espacenet.com database on Jul. 31, 2012, 14 pages.
International Search Report for Application No. PCT/US2012/036327 dated Jul. 11, 2012, 3 pages.
English language abstract for CN 101437931 extracted from the espacenet.com database on Jul. 24, 2013, 18 pages.

* cited by examiner

LUBRICANT COMPOSITION

RELATED APPLICATIONS

This application claims priority to U.S. Ser. No. 61/232,060, filed on Aug. 7, 2009, the disclosure of which is expressly incorporated herein by reference in its entirety.

FIELD OF THE INVENTION

The present invention generally relates to a lubricant composition including an alkylethercarboxylic acid corrosion inhibitor and a base oil. More specifically, the alkylethercarboxylic acid corrosion inhibitor includes an alkyl chain having 6 to 18 carbon atoms.

DESCRIPTION OF THE RELATED ART

Lubricant compositions are generally well known in the art and are broadly categorized as oil or water based compositions, i.e., compositions that include large weight percentages of non-polar compounds or large weight percentages of water. Lubricant compositions are typically further categorized as engine oils, driveline system oils, gear oils, automatic and manual transmission fluids and oils, hydraulic oils, industrial gear oils, turbine oils, rust and oxidation (R&O) inhibited oils, compressor oils, or paper machine oils, etc. Each of these compositions has particular specifications and design requirements. Nevertheless, most are designed to minimize corrosion and wear, resist thermal and physical breakdown, and be able to minimize the effects of common contaminants such as oxidizing compounds and metal fragments.

Many oil based lubricant compositions, such as those that include nonylphenolic corrosion inhibitors, have low compatibility with calcium ions and water present in many applications and tend to physically break down, i.e., emulsify and/or phase combine with the water. As a result, decreased amounts of such corrosion inhibitors are used to reduce emulsification and to promote phase separation such that the lubricant compositions can remain intact and separate from water. However, by decreasing the amounts of corrosion inhibitors used, the protection provided by the lubricant compositions against corrosion also decreases. This is commercially and practically undesirable. Accordingly, there remains an opportunity to develop an improved lubricant composition.

SUMMARY OF THE INVENTION AND ADVANTAGES

The instant invention provides a lubricant composition that includes a base oil and one or more alkylethercarboxylic acid corrosion inhibitor(s) having the formula;

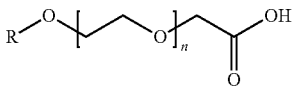

In this formula, R is a straight or branched chain C6-C18 alkyl group and n is a number of from 0 to 5. This invention also provides a method for reducing corrosion of a steel article. The method includes the steps of providing the base oil and providing the one or more alkylethercarboxylic acid corrosion inhibitor(s). The method also includes the step of combining the base oil and the one or more alkylethercarboxylic acid corrosion inhibitor(s) to form the lubricant composition including less than about 0.1 weight percent of the one or more alkylethercarboxylic acid corrosion inhibitor(s). The method further includes the step of applying the lubricant composition to the steel article wherein the steel article passes corrosion testing according to ASTM D 665 B.

The one or more alkylethercarboxylic acid corrosion inhibitor(s) tend to be effective at low concentrations and tend to exhibit excellent demulsibility and calcium compatibility in a variety of lubricant compositions. In addition, the one or more alkylethercarboxylic acid corrosion inhibitor(s) reduce corrosion of steel articles steel while simultaneously minimizing negative interactions with (e.g. antagonism of) anti-wear additives and detergents, when utilized.

DETAILED DESCRIPTION OF THE INVENTION

The present invention provides a lubricant composition. The lubricant composition may be further defined as ash-containing or ash-less, according to ASTM D 874 and known in the art. Typically, the terminology "ash-less" refers to the absence of (significant) amounts of metals such as sodium, potassium, calcium, and the like. Of course, it is to be understood that the lubricant composition is not particularly limited to being defined as either ash-containing or ash-less.

In various embodiments, the lubricant composition can be further described as a fully formulated lubricant or alternatively as an engine oil. In one embodiment, the terminology "fully formulated lubricant" refers to a total final composition that is a final commercial oil. This final commercial oil may include, for instance, detergents, dispersants, antioxidants, antifoam additives, pour point depressants, viscosity index improvers, anti-wear additives, friction modifiers, and other customary additives. In the art, engine oils may be referred to as including a base oil as described below and performance additives. The lubricant composition may be as described in U.S. Ser. No. 61/232,060, filed on Aug. 7, 2009, the disclosure of which is expressly incorporated herein by reference in its entirety. The lubricant composition (hereinafter referred to as "composition") includes a base oil in addition and one or more alkylethercarboxylic acid corrosion inhibitor(s), each of which are described in greater detail below.

Base Oil:

The base oil is not particularly limited and may be further defined as including one or more oils of lubricating viscosity such as natural and synthetic lubricating or base oils and mixtures thereof. In one embodiment, the base oil is further defined as a lubricant. In another embodiment, the base oil is further defined as an oil of lubricating viscosity. In still another embodiment, the base oil is further defined as a crankcase lubricating oil for spark-ignited and compression ignited internal combustion engines, including automobile and truck engines, two-cycle engines, aviation piston engines, and marine and railroad diesel engines. Alternatively, the base oil can be further defined as an oil to be used in gas engines, stationary power engines, and turbines. The base oil may be further defined as a heavy or light duty engine oil. In one embodiment, the base oil is further defined as a heavy duty diesel engine oil. Alternatively, the base oil may be described as an oil of lubricating viscosity or lubricating oil, for instance as disclosed in U.S. Pat. No. 6,787,663 and U.S. 2007/0197407, each of which is expressly incorporated herein by reference. Alternatively, the base oil may be used in or as an engine oil, driveline system oil, gear oil, automatic and manual transmission fluid or oil, hydraulic oil, industrial gear oil, turbine oil, rust and oxidation (R&O) inhibited oil, compressor oil, or paper machine oil, etc. It is also contemplated that the base oil may be as described in U.S. Ser. No. 61/232, 060, filed on Aug. 7, 2009, the disclosure of which is expressly incorporated herein by reference in its entirety.

The base oil may be further defined as a base stock oil. Alternatively, the base oil may be further defined as a component that is produced by a single manufacturer to the same specifications (independent of feed source or manufacturer's location) that meets the same manufacturer's specification and that is identified by a unique formula, product identification number, or both. The base oil may be manufactured or derived using a variety of different processes including but not limited to distillation, solvent refining, hydrogen processing, oligomerization, esterification, and re-refining. Re-refined stock is typically substantially free from materials introduced through manufacturing, contamination, or previous use. In one embodiment, the base oil is further defined as a base stock slate, as is known in the art.

Alternatively, the base oil may be derived from hydrocracking, hydrogenation, hydrofinishing, refined and re-refined oils or mixtures thereof or may include one or more such oils. In one embodiment, the base oil is further defined as an oil of lubricating viscosity such as a natural or synthetic oil and/or combinations thereof. Natural oils include, but are not limited to, animal oils and vegetable oils (e.g., castor oil, lard oil) as well as liquid petroleum oils and solvent-treated or acid-treated mineral lubricating oils such as paraffinic, naphthenic or mixed paraffinic-naphthenic oils.

In various other embodiments, the base oil may be further defined as an oil derived from coal or shale. Non-limiting examples of suitable oils include hydrocarbon oils such as polymerized and interpolymerized olefins (e.g., polybutylenes, polypropylenes, propylene-isobutylene copolymers, poly(1-hexenes), poly(1-octenes), poly(1-decenes), and mixtures thereof; alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof.

In still other embodiments, the base oil may be further defined as a synthetic oil which may include one or more alkylene oxide polymers and interpolymers and derivatives thereof wherein terminal hydroxyl groups are modified by esterification, etherification, or similar reactions. Typically, these synthetic oils are prepared through polymerization of ethylene oxide or propylene oxide to form polyoxyalkylene polymers which can be further reacted to form the oils. For example, alkyl and aryl ethers of these polyoxyalkylene polymers (e.g., methylpolyisopropylene glycol ether having an average molecular weight of 1,000; diphenyl ether of polyethylene glycol having a molecular weight of 500-1,000; and diethyl ether of polypropylene glycol having a molecular weight of 1,000-1,500) and/or mono- and polycarboxylic esters thereof (e.g. acetic acid esters, mixed C3-C8 fatty acid esters, or the C13 oxo acid diester of tetraethylene glycol) may also be utilized.

In even further embodiments, the base oil may include esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include, but are not limited to, dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and combinations thereof. Esters useful as the base oil or as included in the base oil also include those formed from $C_5$ to $C_{12}$ monocarboxylic acids and polyols and polyol ethers such as neopentyl glycol, trimethylolpropane, pentaerythritol, dipentaerythritol, and tripentaerythritol.

The base oil may be alternatively described as a refined and/or re-refined oil, or combinations thereof. Unrefined oils are typically obtained from a natural or synthetic source without further purification treatment. For example, a shale oil obtained directly from retorting operations, a petroleum oil obtained directly from distillation, or an ester oil obtained directly from an esterification process and used without further treatment, could all be utilized in this invention. Refined oils are similar to the unrefined oils except that they typically have undergone purification to improve one or more properties. Many such purification techniques are known to those of skill in the art such as solvent extraction, acid or base extraction, filtration, percolation, and similar purification techniques. Re-refined oils are also known as reclaimed or reprocessed oils and often are additionally processed by techniques directed to removal of spent additives and oil breakdown products.

The base oil may alternatively be described as specified in the American Petroleum Institute (API) Base Oil Interchangeability Guidelines. In other words, the base oil may be further described as one or a combination of more than one of five base oil groups: Group I (sulfur content>0.03 wt %, and/or <90 wt % saturates, viscosity index 80-120); Group II (sulfur content less than or equal to 0.03 wt %, and greater than or equal to 90 wt % saturates, viscosity index 80-120); Group III (sulfur content less than or equal to 0.03 wt %, and greater than or equal to 90 wt % saturates, viscosity index greater than or equal to 120); Group IV (all polyalphaolefins (PAO's)); and Group V (all others not included in Groups I, II, III, or IV). In one embodiment, the base oil is selected from the group consisting of API Group I, II, III, IV, V and combinations thereof. In another embodiment, the base oil is selected from the group consisting of API Group II, III, IV, and combinations thereof. In still another embodiment, the base oil is further defined as an API Group II, III, or IV oil and includes a maximum of about 49.9 wt %, typically up to a maximum of about 40 wt %, more typically up to a maximum of about 30 wt %, even more typically up to a maximum of about 20 wt %, even more typically up to a maximum of about 10 wt % and even more typically up to a maximum of about 5 wt % of the lubricating oil an API Group I or V oil. It is also contemplated that Group II and Group II basestocks prepared by hydrotreatment, hydrofinishing, hydroisomerzation or other hydrogenative upgrading processes may be included in the API Group II described above. Moreover, the base oil may include Fisher Tropsch or gas to liquid GTL oils. These are disclosed for example in U.S. 2008/0076687, which is expressly incorporated herein by reference.

The base oil is typically present in the composition in an amount of from 70 to 99.9, from 80 to 99.9, from 90 to 99.9, from 75 to 95, from 80 to 90, or from 85 to 95, parts by weight per 100 parts by weight of the composition. Alternatively, the base oil may be present in amounts of greater than 70, 75, 80, 85, 90, 91, 92, 93, 94, 95, 96, 97, 98, or 99, parts by weight per 100 parts by weight of the composition. In various embodiments, the amount of lubricating oil in a fully formulated lubricant (including diluent or carrier oils presents) is from about 80 to about 99.5 percent by weight, for example, from about 85 to about 96 percent by weight, for instance from about 90 to about 95 percent by weight. Of course, the weight percent of the base oil may be any value or range of values, both whole and fractional, within those ranges and values described above and/or may vary from the values and/or range of values above by ±5%, ±10%, ±15%, ±20%, ±25%, ±30%, etc.

One or More Alkylethercarboxylic Acid Corrosion Inhibitor(s):

The one or more alkylethercarboxylic acid corrosion inhibitor(s) each has the formula;

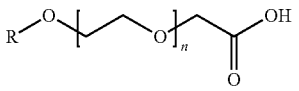

wherein R is a straight or branched chain $C_6$-$C_{18}$ alkyl group and n is a number of from 0 to 5. The alkyl group may be branched or unbranched and may be further defined as, for example, 2-ethylbutyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl, 2-ethylhexyl, 1,1,3-trimethylhexyl, 1,1,3,3-tetramethylpentyl, nonyl, decyl, undecyl, 1-methylundecyl, dodecyl, 1,1,3,3,5,5-hexamethylhexyl, tridecyl, tetradecyl, pentadecyl, hexadecyl, heptadecyl or octadecyl. In various embodiments, n is a number from 1 to 5, from 2 to 5, from 3 to 5, from 4 to 5, from 2 to 4, from 3 to 4, from 1 to 4, from 1 to 3, or from 1 to 2. In one embodiment, R is a mixture of $C_{12}/C_{14}$ alkyl groups and n is 2.5. Alternatively, n can be further defined as having an "average" value from 1 to 5, from 2 to 5, from 3 to 5, from 4 to 5, from 2 to 4, from 3 to 4, from 1 to 4, from 1 to 3, or from 1 to 2. In these embodiments, the terminology "average value" typically refers to the mean value of n when a mixture of compounds is included. Of course, n may be any value or range of values, both whole and fractional and both actual or average (mean), within those ranges and values described above and/or may vary from the values and/or range of values above by ±5%, ±10%, ±15%, ±20%, ±25%, ±30%, etc.

In one embodiment, R is a mixture of $C_{16}/C_{18}$ alkyl groups and n is 2. In still another embodiment, R is a straight or branched chain $C_{12}$-$C_{14}$ alkyl group and n is about 3. Alternatively, R can include blends of alkyl groups that have even numbers of carbon atoms or odd numbers of carbon atoms, or both. For example, R can include mixtures of $C_x/C_y$ alkyl groups wherein x and y are odd numbers or even numbers. Alternatively, one may be an odd number and the other may be an even number. Typically, x and y are numbers that differ from each other by two, e.g. 6 and 8, 8 and 10, 10 and 12, 12 and 14, 14 and 16, 16 and 18, 7 and 9, 9 and 11, 11 and 13, 13 and 15, or 15 and 17. R can also include mixtures of 3 or more alkyl groups, each of which may include even or odd numbers of carbon atoms. For example, R may include a mixture of $C_9$, $C_{10}$, $C_{11}$, $C_{12}$, $C_{13}$, $C_{14}$, and/or $C_{15}$ alkyl groups. Typically, if R is a mixture of alkyl groups then at least two alkylethercarboxylic acid corrosion inhibitor(s) are present. In other words, no single alkylethercarboxylic acid has two different alkyl groups represented by the same variable R. Thus, the terminology "mixture of alkyl groups" typically refers to a mixture of alkylethercarboxylic acid corrosion inhibitor(s) wherein one type of molecule has a particular alkyl group and a second or additional compounds have other types of alkyl groups.

Accordingly, it is to be understood that the terminology "one or more alkylethercarboxylic acid corrosion inhibitor(s)" may describe a single compound or a mixture of compounds, each of which are alkylethercarboxylic acid corrosion inhibitor(s) of the above described formula. The one or more alkylethercarboxylic acid corrosion inhibitor(s) act as corrosion inhibitors but are not limited to this function. Said differently, one or more alkylethercarboxylic acid corrosion inhibitor(s) may also have additional uses or functions in the composition.

Some alkylethercarboxylic acid corrosion inhibitor(s) are commercially available, for instance AKYPO RLM 25 and AKYPO RO 20 VG, from Kao Specialties Americas LLC. The alkylethercarboxylic acid corrosion inhibitor(s) may also be prepared from alcohol ethoxylates via oxidation, for instance as taught in U.S. Pat. No. 4,214,101, expressly incorporated herein by reference. The alkylethercarboxylic acid corrosion inhibitor(s) may also be prepared by carboxylmethylation of detergent alcohols as disclosed in U.S. Pat. Nos. 5,233,087 or 3,992,443, each of which is also expressly incorporated herein by reference. It is also contemplated that the one or more alkylethercarboxylic acid corrosion inhibitor(s) may be as described in U.S. Ser. No. 61/232,060, filed on Aug. 7, 2009, the disclosure of which is expressly incorporated herein by reference in its entirety.

The one or more alkylethercarboxylic acid corrosion inhibitor(s) are typically present in the composition in amounts of from about 0.01 to about 0.07 parts by weight per 100 parts by weight of the composition. In various embodiments, the one or more alkylethercarboxylic acid corrosion inhibitor(s) are present in amounts of about 0.01, 0.02, 0.03, 0.04, 0.05, 0.06, or 0.07, parts by weight per 100 parts by weight of the composition. In other embodiments, the one or more alkylethercarboxylic acid corrosion inhibitor(s) are present in amounts of from about 0.01 to 0.07, 0.02 to 0.06, 0.03 to 0.05, or 0.04 to 0.05, parts by weight per 100 parts by weight of the composition. In still other embodiments, the one or more alkylethercarboxylic acid corrosion inhibitor(s) may be present in amount of from 0.1 to 1 parts by weight per 100 parts by weight of the composition. In various embodiments, the one or more alkylethercarboxylic acid corrosion inhibitor(s) may be present in amounts of from 0.01 to 0.2, from 0.05 to 0.2, from 0.1 to 0.2, from 0.15 to 0.2, etc, parts by weight per 100 parts by weight of the composition. Additional non-limiting examples of various suitable parts by weight include 0.1, 0.2, 0.3, 0.4, 0.5, 0.6, 0.7, 0.8, 0.9, and 1.0. Of course, the weight percent of the one or more alkylethercarboxylic acid corrosion inhibitor(s) may be any value or range of values, both whole and fractional, within those ranges and values described above and/or may be present in amounts that vary from the values and/or range of values above by ±5%, ±10%, ±15%, ±20%, ±25%, ±30%, etc.

Additives:

The composition can additionally include one or more additives to improve various chemical and/or physical properties. Non-limiting examples of the one or more additives include anti-wear additives, metal passivators, rust inhibitors, viscosity index improvers, pour point depressors, dispersants, detergents, and antifriction additives. One or more of the additives may be ash-containing or ash-less as first introduced and described above. Such composition is commonly referred to as an engine oil or as an industrial oil, such as a hydraulic fluid, a turbine oil, an R&O (rust and oxidation inhibited) oil or a compressor oil.

Anti-Wear Additive:

The anti-wear additive first introduced above is not particularly limited and may be any known in the art. It may be ash-containing or ash-less, as first introduced and described above. In one embodiment, the anti-wear additive is selected from the group of ZDDP, zinc dialkyl-dithio phosphates, and combinations thereof. Alternatively, the anti-wear additive may include sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio] propionate, triphenyl thiophosphate (triphenylphosphorothioate), tris(alkylphenyl)phosphorothioate and mixtures thereof (for example tris(isononylphenyl)phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof. In one embodiment, the anti-wear additive include phosphorous and sulfur, e.g. in phosphorothionates and/or dithiophosphate esters. It is also contemplated that the anti-wear additive may be as described in U.S. Ser. No. 61/232,060, filed on Aug. 7, 2009, the disclosure of which is expressly incorporated herein by reference in its entirety.

The anti-wear additive is typically present in the composition in an amount of from 0.1 to 20, from 0.5 to 15, from 1 to 10, from 5 to 10, from 5 to 15, from 5 to 20, from 0.1 to 1, from 0.1 to 0.5, or from 0.1 to 1.5, parts by weight per 100 parts by weight of the composition. Alternatively, the anti-wear additive may be present in amounts of less than 20, less than 15, less than 10, less than 5, less than 1, less than 0.5, or less than 0.1, parts by weight per 100 parts by weight of the composition. Of course, the weight percent of the anti-wear additive may be any value or range of values, both whole and fractional, within those ranges and values described above and/or may vary from the values and/or range of values above by ±5%, ±10%, ±15%, ±20%, ±25%, ±30%, etc.

Antioxidants:

Suitable, non-limiting, antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Other non-limiting examples of suitable antioxidants includes alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate, and combinations thereof, may also be utilized.

Furthermore, hydroxylated thiodiphenyl ethers, for example 2, 2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2, 2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercapto butane, ethylene glycol bis[3,3-bis(3'-tert-butyl-4'-hydroxyphenyl) butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants.

O-, N- and S-benzyl compounds, for example 3, 5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate, and combinations thereof are also suitable for use as antioxidants.

Triazine Compounds, for example 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris(3,5-di-tert-butyl-4-hydroxyphenyl propionyl)-hexahydro-1,3,5-triazine, 1,3,5-tris(3,5-dicyclohexyl-4-hydroxybenzyl) isocyanurate, and combinations thereof, may also be used.

Additional suitable, but non-limiting examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl 3,5-di-tert-butyl-4-hydroxybenzylphosphonate, dioctadecyl-5-tert-butyl-4-hydroxy 3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may also be used. It is further contemplated that esters of β-(5-tert-butyl-4-hydroxy-3-methylphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be used. Esters of 13-(3,5-dicyclohexyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may also be used. Moreover, esters of 3,5-di-tert-butyl-4-hydroxyphenyl acetic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be utilized.

Additional non-limiting examples of suitable antioxidants include those that include nitrogen, such as amides of β-(3,5-di-tert-butyl-4-hydroxyphenyl)propionic acid e.g. N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable non-limiting examples of antioxidant include aminic antioxidants such as N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino)propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethyl piperid-4-yl)sebacate, 2,2,6,6-tetramethylpiperidin-4-one and 2,2,6,6-tetramethyl piperidin-4-ol, and combinations thereof.

Even further non-limiting examples of suitable antioxidants includes aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1-trithiamidecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used. It is also contemplated that the antioxidant may be as described in U.S. Ser. No. 61/232,060, filed on Aug. 7, 2009, the disclosure of which is expressly incorporated herein by reference in its entirety.

The one or more antioxidants are not particularly limited in amount in the composition but are typically present in an amount of from 0.1 to 2, 0.5 to 2, 1 to 2, or 1.5 to 2, parts by weight per 100 parts by weight of the composition. Alternatively, the one or more antioxidants may be present in amounts of less than 2, less than 1.5, less than 1, or less than 0.5, parts by weight per 100 parts by weight of the composition. Of course, the weight percent of the one or more antioxidants may be any value or range of values, both whole and fractional, within those ranges and values described above and/or may be present in amounts that vary from the values and/or range of values above by ±5%, ±10%, ±15%, ±20%, ±25%, ±30%, etc.

Metal Deactivators:

In various embodiments, one or more metal deactivators can be included in the composition. Suitable, non-limiting examples of the one or more metal deactivators include benzotriazoles and derivatives thereof, for example 4- or 5-alkylbenzotriazoles (e.g. triazole) and derivatives thereof, 4,5,6,7-tetrahydrobenzotriazole and 5,5'-methylenebisbenzotriazole; Mannich bases of benzotriazole or triazole, e.g. 1-[bis(2-ethylhexyl)aminomethyl)triazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl)triazole, and combinations thereof.

Additional non-limiting examples of the one or more metal deactivators include 1,2,4-triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2, 4-triazoles, imidazole derivatives, for example 4, 4'-methylenebis(2-undecyl-5-methylimidazole) and bis[(N-methyl) imidazol-2-yl]carbinol octyl ether, and combinations thereof.

Further non-limiting examples of the one or more metal deactivators include sulfur-containing heterocyclic compounds, for example 2-mercaptobenzothiazole, 2,5-dimercapto-1,3,4-thiadiazole and derivatives thereof; and 3,5-bis [di(2-ethylhexyl)aminomethyl]-1,3,4-thiadiazolin-2-one, and combinations thereof. Even further non-limiting examples of the one or more metal deactivators include amino compounds, for example salicylidenepropylenediamine, salicylaminoguanidine and salts thereof, and combinations thereof. It is also contemplated that the metal deactivator may be as described in U.S. Ser. No. 61/232,060, filed on Aug. 7, 2009, the disclosure of which is expressly incorporated herein by reference in its entirety.

The one or more metal deactivators are not particularly limited in amount in the composition but are typically present in an amount of from 0.01 to 0.1, from 0.05 to 0.01, or from 0.07 to 0.1, parts by weight per 100 parts by weight of the composition. Alternatively, the one or more metal deactivators may be present in amounts of less than 0.1, of less than 0.7, or less than 0.5, parts by weight per 100 parts by weight of the composition. The weight percent of the one or more metal deactivators may be any value or range of values, both whole and fractional, within those ranges and values described above and/or may be present in amounts that vary from the values and/or range of values above by ±5%, ±10%, ±15%, ±20%, ±25%, ±30%, etc.

Rust Inhibitors and Friction Modifiers:

In various embodiments, one or more rust inhibitors and/or friction modifiers can be included in the composition. Suitable, non-limiting examples of the one or more rust inhibitors and/or friction modifiers include organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example dodecenylsuccinic anhydride, 2-carboxymethyl-1-dodecyl-3-methylglycerol and the amine salts thereof, and combinations thereof. Additional suitable, non-limiting examples of the one or more rust inhibitors and/or friction modifiers include nitrogen-containing compounds, for example, primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy)propan-2-ol, and combinations thereof. Further suitable, non-limiting examples of the one or more rust inhibitors and/or friction modifiers include heterocyclic compounds, for example: substituted imidazolines and oxazolines, and 2-heptadecenyl-1-(2-hydroxyethyl)imidazoline, phosphorus-containing compounds, for example: Amine salts of phosphoric acid partial esters or phosphonic acid partial esters, and zinc dialkyldithiophosphates, molybdenum-containing compounds, such as molydbenum dithiocarbamate and other sulfur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols, and combinations thereof. It is also contemplated that the rust inhibitors and friction modifiers may be as described in U.S. Ser. No. 61/232,060, filed on Aug. 7, 2009, the disclosure of which is expressly incorporated herein by reference in its entirety.

The one or more rust inhibitors and friction modifiers are not particularly limited in amount in the composition but are typically present in an amount of from 0.05 to 0.5, 0.01 to 0.2, from 0.05 to 0.2, 0.1 to 0.2, 0.15 to 0.2, or 0.02 to 0.2, parts by weight per 100 parts by weight of the composition. Alternatively, the one or more rust inhibitors and friction modifiers may be present in amounts of less than 0.5, less than 0.4, less than 0.3, less than 0.2, less than 0.1, less than 0.5, or less than 0.1, parts by weight per 100 parts by weight of the composition. The weight percent of the one or more rust inhibitors and friction modifiers may be any value or range of values, both whole and fractional, within those ranges and values described above and/or may be present in amounts that vary from the values and/or range of values above by ±5%, ±10%, ±15%, ±20%, ±25%, ±30%, etc.

Viscosity Index Improvers:

In various embodiments, one or more viscosity index improvers can be included in the composition. Suitable, non-limiting examples of the one or more viscosity index improvers include polyacrylates, polymethacrylates, vinylpyrrolidone/methacrylate copolymers, polyvinylpyrrolidones, polybutenes, olefin copolymers, styrene/acrylate copolymers and polyethers, and combinations thereof. It is also contemplated that the viscosity index improvers may be as described in U.S. Ser. No. 61/232,060, filed on Aug. 7, 2009, the disclosure of which is expressly incorporated herein by reference in its entirety. The one or more viscosity index improvers are not particularly limited in amount in the composition but are typically present in an amount of from 1 to 1, from 2 to 8, from 3 to 7, from 4 to 6, or from 4 to 5, parts by weight per 100 parts by weight of the composition. Alternatively, the one or more viscosity index improvers may be present in an amount of less than 10, 9, 8, 7, 6, 5, 4, 3, 2, or 1, part by weight per 100 parts b eight of the composition. The weight percent of the one or more viscosity index improvers may be any value or range of values, both whole and fractional, within those ranges and values described above and/or may be present in amounts that vary from the values and/or range of values above by ±5%, ±10%, ±15%, ±20%, ±25%, ±30%, etc.

Pour Point Depressants:

In various embodiments, one or more pour point depressants can be included in the composition. Suitable, non-limiting examples of the pour point depressants include polymethacrylate and alkylated naphthalene derivatives, and combinations thereof. It is also contemplated that the pour point depressants may be as described in U.S. Ser. No. 61/232,060, filed on Aug. 7, 2009, the disclosure of which is expressly incorporated herein by reference in its entirety. The one or more pour point depressants are not particularly limited in amount in the composition but are typically present in an amount of from 0.1 to 1, from 0.5 to 1, or from 0.7 to 1, part by weight per 100 parts by weight of the composition. Alternatively, the one or more pour point depressants may be present in amounts of less than 1, less than 0.7, or less than 0.5, parts by weight per 100 parts by weight of the composition. The weight percent of the one or more pour point depressants may be any value or range of values, both whole and fractional, within those ranges and values described above and/or may be present in amounts that vary from the values and/or range of values above by ±5%, ±10%, ±15%, ±20%, ±25%, ±30%, etc.

Dispersants:

In various embodiments, one or more dispersants can be included in the composition. Suitable, non-limiting examples of the one or more dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof. It is also contemplated that the dispersants may be as described in U.S. Ser. No. 61/232,060, filed on Aug. 7, 2009, the disclosure of which is expressly incorporated herein by reference in its entirety.

The one or more dispersants are not particularly limited in amount in the composition but are typically present in an amount of from 0.1 to 5, from 0.5 to 4.5, from 1 to 4, from 1.5 to 3.5, from 2 to 3, or from 2.5 to 3, parts by weight per 100 parts by weight of the composition. Alternatively, the one or more dispersants may be present in an amount of less than 5, 4.5, 3.5, 3, 2.5, 2, 1.5, or 1, part by weight per 100 parts by weight of the composition. The weight percent of the one or more dispersants may be any value or range of values, both whole and fractional, within those ranges and values described above and/or may be present in amounts that vary from the values and/or range of values above by ±5%, ±10%, ±15%, ±20%, ±25%, ±30%, etc.

Detergents:

In various embodiments, one or more detergents can be included in the composition. Suitable, non-limiting examples of the one or more detergents include overbased or neutral metal sulphonates, phenates and salicylates, and combinations thereof. It is also contemplated that the detergents may be as described in U.S. Ser. No. 61/232,060, filed on Aug. 7, 2009, the disclosure of which is expressly incorporated herein by reference in its entirety.

The one or more detergents are not particularly limited in amount in the composition but are typically present in an amount of from 0.1 to 5, from 0.5 to 4.5, from 1 to 4, from 1.5 to 3.5, from 2 to 3, or from 2.5 to 3, parts by weight per 100 parts by weight of the composition. Alternatively, the one or more detergents may be present in an amount of less than 5, 4.5, 3.5, 3, 2.5, 2, 1.5, or 1, part by weight per 100 parts by weight of the composition. The weight percent of the one or more detergents may be any value or range of values, both whole and fractional, within those ranges and values described above and/or may be present in amounts that vary from the values and/or range of values above by ±5%, ±10%, ±15%, ±20%, ±25%, ±30%, etc.

In various embodiments, the composition is substantially free of water, e.g. includes less than 5, 4, 3, 2, or 1, weight percent of water. Alternatively, the composition may include less than 0.5 or 0.1 weight percent of water or may be free of water. Of course, the weight percent of the water may be any value or range of values, both whole and fractional, within those ranges and values described above and/or may be present in amounts that vary from the values and/or range of values above by ±5%, ±10%, ±15%, ±20%, ±25%, ±30%, etc.

The instant invention also provides an additive concentrate package which includes one or more metal deactivators, one or more antioxidants, one or more anti-wear additives, and the one or more alkylethercarboxylic acid corrosion inhibitor of this invention. One or more of the additives may be ash-containing or ash-less as first introduced and described above. In various embodiments, the additive concentrate package may include one or more additional additives as described above. The additive package may be included in the composition in amounts of from 0.1 to 1, from 0.2 to 0.9, from 0.3 to 0.8, from 0.4 to 0.7, or from 0.5 to 0.6, parts by weight per 100 parts by weight of the composition. The weight percent of the additive concentrate package may be any value or range of values, both whole and fractional, within those ranges and values described above and/or may be present in amounts that vary from the values and/or range of values above by ±5%, ±10%, ±15%, ±20%, ±25%, ±30%, etc.

Some of the compounds described above may interact in the lubricant composition, so the components of the lubricant composition in final form may be different from those components that are initially added or combined together. Some products formed thereby, including products formed upon employing the composition of this invention in its intended use, are not easily described or describable. Nevertheless, all such modifications, reaction products, and products formed upon employing the composition of this invention in its intended use, are expressly contemplated and hereby included herein. Various embodiments of this invention include one or more of the modification, reaction products, and products formed from employing the composition, as described above.

Method for Reducing Corrosion of a Steel Article:

This invention also provides a method for reducing corrosion of a steel article using the composition that includes less than about 0.1 weight percent of one or more alkylethercarboxylic acid corrosion inhibitor(s). The method includes the steps of providing the base oil and providing the one or more alkylethercarboxylic acid corrosion inhibitor(s). The method also includes the steps of combining the base oil and the one or more alkylethercarboxylic acid corrosion inhibitor(s) to form the composition and applying the composition to the steel article to reduce corrosion. After application of the composition to the steel article, the steel article passes corrosion testing according to ASTM D 665 B.

Evaluation of Various Embodiments of the Composition:

As described immediately above, the composition may be applied to the steel article to reduce corrosion of that article. The steel article is typically evaluated according to ASTM D 665 B to determine whether any corrosion occurs and whether the article passes the test. Independently from whether the steel article passes ASTM D 665 B, the composition also typically passes ASTM D 1401 with an emulsion time of less than 30, 25, 20, 15, 10, 9, 8, 7, 6, 5, or 4, minutes. Moreover, the composition typically has a calcium compatibility measured according to a filtration index of 1.5, 1.45, 1.4, 1.35, 1.3, 1.25, 1.2, 1.15, 1.1, 1.05, or 1, as determined using the modified Lubrication Engineering method described in greater detail below.

EXAMPLES

Various alkylethercarboxylic acid corrosion inhibitors (Inhibitors 1-9) are formed according to the instant invention and are utilized herein. Two additional alkylethercarboxylic acid corrosion inhibitors (Inhibitors 10 and 11) are also representative examples of the corrosion inhibitor of this invention and are utilized herein.

Each of the Inhibitors 1-11 is used to form a lubricant composition (Compositions 1-11). Each of these Compositions is applied to a steel article to reduce corrosion of that article. The steel article is evaluated according to ASTM D 665 B to determine whether any corrosion occurs and whether the article passes the test. Each of the Inhibitors 1-11 are also used to form additional lubricant compositions (Compositions 12-22) which are evaluated to determine demulsibility according to ASTM D 1401 and calcium compatibility according to a modified method described in Lubrication Engineering, 2000, 56(4), pp. 22-31. In this method, a sample of the composition is treated with a calcium containing detergent to a final concentration level of 33 ppm calcium and 0.1% water in a blender for five minutes, then stored in a sealed container at 70° C. for 96 hours, then for 48 hours in the dark at room temperature. If the oil appears lucid and clear, it is filtered through a 0.8 μm filter according to AFNOR NF E 48-690, and the degree of filter blockage expressed as a filtration index according to the method is measured. A filtration index close to 1 is desired. A failure is noted if a precipitate is observed, if the filter becomes blocked during filtration, or if the filtration index greater than 2 is calculated.

Three comparative corrosion inhibitors (Comparative Inhibitors 1-3) which do not represent this invention are also utilized herein. These Comparative Inhibitors are used to form comparative lubricant compositions (Comparative Compositions 1-6). Comparative Compositions 1-3 are applied to a steel article to reduce corrosion of that article. The steel article is evaluated according to ASTM D 665 B to determine whether any corrosion occurs and whether the article passes the test. Comparative Compositions 4-6 are evaluated to determine demulsibility according to ASTM D 1401 and calcium compatibility according to the modified Lubrication Engineering method referenced above. The results of these evaluations are set forth below.

Formation of Inhibitor 1: Carboxymethylation of an Alkyl Ethoxylate

Sodium t-butoxide (3.34 g, 35.6 mmol) is dissolved in 17.5 mL of LIAL 125 at 100° C. The resulting clear and viscous solution is transferred by cannula into a mixture of sodium chloroacetate (4.11 g, 35.3 mmol) and LIAL 125 (2.5 mL, 81.1 mmol total) held at 60° C. The resulting mixture is heated to 100° C. for 20 hours, then allowed to cool to room temperature and slowly diluted with 25 mL of acetone. A white precipitate forms which is collected by filtration and washed with acetone. The filter cake is dissolved in water and the pH adjusted to below 3 with 1 M aqueous HCl. The resulting mixture is extracted 3 times with ethyl acetate and the combined organic extracts are washed with brine, dried over magnesium sulfate, filtered and concentrated to afford the carboxylmethylation product of LIAL 125. The product is purified by flash chromatography. LIAL 125 is a $C_{12}$-$C_{15}$ alkyl alcohol with a molecular weight of 207 g/m available from Sasol.

Formation of Inhibitor 2: Jones Procedure for Oxidation of Alcohol Ethoxylates

A 500 mL round bottom flask is charged with TOMADOL 23-1 (10 g) which is dissolved in 100 mL of acetone. Jones reagent is added dropwise via an addition funnel. The solution turns a dark green color. The reagent is added until an orange/red color persists. Excess Jones reagent is quenched by addition of several mL of isopropanol. Upon completion, the mixture is diluted with 100 mL of water followed by 100 mL of ethyl acetate. The organic layer is extracted, washed with 1N HCl and brine, dried over magnesium sulfate, filtered and concentrated to afford the desired ether carboxylic acid as a pale blue oil. TOMADOL 23-1 is a $C_{12}$-$C_{13}$ alkyl 1 mol ethoxylate, Air Products.

Formation of Inhibitor 3: TEMPO/$NaClO_2$ Method for Oxidation of Alcohol Ethoxylates A 5 L three neck round bottom flask equipped with a mechanical stirrer is charged with LUTENSOL TDA-3 (110.1 g, 0.339 mol; a $C_{13}$ alkyl 3 mol ethoxylate, BASF), TEMPO (3.71 g, 0.024 mol), acetonitrile (1.69 L) and 0.67 M sodium phosphate buffer (1.25 L of a 1:1 mixture of 0.67 M $NaH_2PO_4$ and 0.67 M $Na_2HPO_4$). The reaction mixture is heated to 40° C. with stirring and approximately 20% of a $NaClO_2$ solution (prepared by dissolving 80% $NaClO_2$ (76.6 g, 0.68 mol) in 335 mL water) is added vial an addition funnel, followed by 20% of a bleach solution (prepared by diluting a commercial bleach (9.61 g, 0.007 mol) in 162 mL water. Commercial bleach is 5.25% NaOCl). The remaining portions of both solutions are added simultaneously over a 2 hour period.

Upon completion (about 6 to 12 hours) the reaction is cooled to room temperature and quenched with 1 L of water. The pH is adjusted by addition of NaOH followed by addition of ice cold aqueous sodium sulfite. The resulting solution is stirred for 20 minutes followed by addition of 500 mL of ethyl acetate. After stirring for 15 minutes, the organic layer is separated and discarded. An additional 200 mL of ethyl acetate is added and the solution is acidified to pH 2 with concentrated HCl. The organic layer is separated and the aqueous layer is washed with two more portions of ethyl acetate. The organic layers are combined, washed with water, brine, dried over magnesium sulfate and concentrated. The product is a pale yellow oil.

Formation of Inhibitors 4-9:

The Inhibitors 4-9 are formed using either the Jones Method or the TEMPO method described above.

Inhibitor 4: NOVEL TDA-1, Sasol, a $C_{13}$ alkyl 1 mol ethoxylate, Jones Method Inhibitor 5: NOVEL 23E1, Sasol, a $C_{12}$/$C_{13}$ alkyl 1 mol ethoxylate, Jones Method Inhibitor 6: AE-2, Proctor & Gamble, a $C_{12}$/$C_{14}$ alkyl 2 mol ethoxylate, TEMPO Method Inhibitor 7: NEODOL 23-2, Shell, a $C_{12}$/$C_{13}$ alkyl 2 mol ethoxylate, TEMPO Method Inhibitor 8: NEODOL 23-3, Shell, a $C_{12}$/$C_{13}$ alkyl 3 mol ethoxylate, TEMPO Method Inhibitor 9: TERGITOL 15-s-3, Dow, a $C_{15}$ alkyl 3 mol ethoxylate, TEMPO Method Inhibitors 10 and 11:

Inhibitor 10 is a $C_{16}$/$C_{18}$ alkyl 2 mol ethoxylate.

Inhibitor 11 is a $C_{12}$/$C_{14}$ alkyl 2.5 mol ethoxylate.

Compositions 1-11 and Comparative Compositions 1-3:

The Compositions 1-11 are prepared using 0.05 wt % of the Inhibitors 1-11 described above, respectively, and also each include a blend of phenolic and alkylated diphenylamine antioxidants at 0.2 wt %, a triazole metal deactivator at 0.05 wt %, and a balance of a Group II base oil. Percents are weight percent based on weight of the base oil.

The Comparative Compositions 1-3 are prepared in the same way as described immediately above except that the Inhibitors 1-11 of this invention are replaced with one of IRGACOR L 12, MONACOR 39, and K-Corr 100. IRGACOR L 12 is an alkenyl succinic acid half ester that is commercially available from BASF. MONACOR 39 is an aspartic acid ester that is commercially available from Uniqema. K-Corr 100 is an ester/amide/carboxylate based additive that is commercially available from King Industries. After formation, each of the Compositions 1-11 and the Comparative Compositions 1-3 are evaluated using ASTM D 665 B, the results of which are set forth immediately below.

| Compositions | Test Results ASTM D 665B (Pass/Fail) |
|---|---|
| Composition 1 | Pass |
| Composition 2 | Pass |
| Composition 3 | Pass |
| Composition 4 | Pass |
| Composition 5 | Pass |
| Composition 6 | Pass |
| Composition 7 | Pass |

-continued

| Compositions | Test Results ASTM D 665B (Pass/Fail) |
|---|---|
| Composition 8 | Pass |
| Composition 9 | Pass |
| Composition 10 | Pass |
| Composition 11 | Pass |
| Comparative Composition 1 | Pass |
| Comparative Composition 2 | Pass |
| Comparative Composition 3 | Fail (Pass at 0.2%) |

The data set forth immediately above evidences that the Compositions 1-11 that include various alkylethercarboxylic acid corrosion inhibitors of this invention allow the steel article to pass ASTM D 665 B relative to corrosion. Notably, the alkylethercarboxylic acid corrosion inhibitors of this invention are effective at the same treat rates used with commercially available materials IRGACOR L 12 and MONACOR 39, and at a treat rate that is lower than the treat rate used with K-Corr 100.

Compositions 12-22 and Comparative Compositions 4-6:

The Compositions 12-22 are prepared using 0.10 wt % of the Inhibitors 1-11 described above, a blend of phenolic and alkylated diphenylamine antioxidants at 0.2 wt %, a triazole metal deactivator at 0.05 wt %, and a balance of a Group II base oil. Percents are weight percent based on weight of the base oil. The Comparative Compositions 4-6 are prepared in the same way as described immediately above except that the Inhibitors of this invention are replaced with IRGACOR L 12, MONACOR 39, and K-Corr 100. After formation, the Compositions 12-22 and the Comparative Compositions 4-6 are tested to determine demulsibility according to ASTM D 1401 and calcium compatibility according to the modified Lubrication Engineering method referenced above. The results of these evaluations are set forth below.

Relative to ASTM D 1401, the time (minutes) needed for a 3 mL emulsion layer to form in each of the Compositions is measured. The volume of each of the oil, water, and emulsion phases (represented as oil/water/emulsion in the Table) is recorded in mL. The calcium compatibility is measured according to the modified Lubrication Engineering method referenced above. A sample of the Compositions is treated with a calcium containing detergent to a final concentration level of 33 ppm calcium and 0.1% water in a blender for five minutes, then stored in a sealed container at 70° C. for 96 hours, then for 48 hours in the dark at room temperature. If the oil appears lucid and clear, it is filtered through a 0.8 μm filter according to AFNOR NF E 48-690, and the degree of filter blockage expressed as a filtration index according to the method is measured. A filtration index close to 1 is desired. A failure is noted if a precipitate is observed, if the filter becomes blocked during filtration, or if the Filtration Index greater than 2 is calculated.

| Composition | Test Results ASTM D 1401 (oil/water/ emulsion (min)) | Calcium Compatibility (Filtration Index) |
|---|---|---|
| Composition 12 | 40/40/0 (6) | 1.07 |
| Composition 13 | 40/40/0 (4) | 1.36 |
| Composition 14 | 40/39/1 (10) | 1.14 |
| Composition 15 | 40/40/0 (4) | 1.29 |
| Composition 16 | 40/40/0 (7) | 1.25 |
| Composition 17 | 40/39/1 (5) | 1.22 |

-continued

| Composition | Test Results ASTM D 1401 (oil/water/ emulsion (min)) | Calcium Compatibility (Filtration Index) |
|---|---|---|
| Composition 18 | 40/39/1 (5) | 1.26 |
| Composition 19 | 40/40/0 (5) | Not Determined |
| Composition 20 | 38/39/3 (10) | 1.18 |
| Composition 21 | 38/40/2 (30) | 0.93 |
| Composition 22 | 40/39/1 (20) | 1.06 |
| Comparative Composition 4 | 40/40/0 (9) | Fail |
| Comparative Composition 5 | 2/2/76 (30) | 1.05 |
| Comparative Composition 6 | 40/40/0 (8.5) | 0.97 |

The data set forth above evidences that the various alkylethercarboxylic acid corrosion inhibitors of this invention, in addition to providing to the superior results outlined above relative to ASTM D 665 B, also provide superior demulsibility and calcium compatibility. More specifically, the various alkylethercarboxylic acid corrosion inhibitors of this invention allow the steel article to resist corrosion as measured using ASTM D 665 B while simultaneously avoiding issues of demulsibility and incompatibility with traces of calcium containing detergents. Accordingly, the various alkylethercarboxylic acid corrosion inhibitors of this invention allow the lubricant compositions to be superior relative to corrosion resistance and at a the same time resist the demulsibility and incompatibility problems that plague typical commercially available products.

Compositions 23-30 and Comparative Compositions 7-16:

Compositions 23-30 are formed according to this invention and include a Group II ISO VG 46 base oil, 0.48 wt % of a combination of additives described below, 0.04 wt % glycerol monooleate, and varying amounts of Inhibitor 10.

Comparative Compositions 7-16 include the same Group II ISO VG base oil, the same 0.48 wt % of the combination of additives, and the same 0.04 wt % glycerol monooleate as Compositions 23-30. However, Comparative Compositions 7-11 substitute various amounts of Irgacor NPA for Inhibitor 10. Comparative Formulations 12-16 substitute various amounts Irgacor L12 for Inhibitor 10. Irgacor NPA is a nonylphenoxyacetic acid. Irgacor L12 is a mixture of succinic acid partial esters.

| Combination of Additives | Approximate Parts by Weight Each of the Additives Per 100 Parts by Weight of the Combination |
|---|---|
| Aminic Antioxidant(s) | 51 ± 3 |
| EO/PO Block Copolymer(s) (Demulsifier) | 0.4 ± 0.3 |
| Anti-Wear Additive(s) | 40 ± 3 |
| Benzotriazole Derivative(s) (Metal Deactivator) | 8 ± 2 |

Each of Compositions 23-30 and the Comparative Compositions 7-16 is applied to a steel article to reduce corrosion of that article. The steel article is evaluated according to ASTM D 665 B to determine whether any corrosion occurs and whether the article passes the test. The results of these evaluations are set forth immediately below.

| | Composition 23 | Composition 24 | Composition 25 | Composition 26 | Composition 27 |
|---|---|---|---|---|---|
| Combination of Additives | 0.48 | 0.48 | 0.48 | 0.48 | 0.48 |
| Composition 10 | 0.015* | 0.02* | 0.025 | 0.03* | 0.04 |
| Irgacor NPA | — | — | — | — | — |
| Irgacor L12 | — | — | — | — | — |
| ASTM D 665B | Fail | Pass | Pass | Pass | Pass |

| | Composition 28 | Composition 29 | Composition 30 | Comp. Composition 7 | Comp. Composition 8 |
|---|---|---|---|---|---|
| Combination of Additives | 0.48 | 0.48 | 0.48 | 0.48 | 0.48 |
| Composition 10 | 0.05 | 0.06 | 0.07 | — | — |
| Irgacor NPA | — | — | — | 0.015 | 0.02 |
| Irgacor L12 | — | — | — | — | — |
| ASTM D 665B | Pass | Pass | Pass | Pass | Pass |

| | Comp. Composition 9 | Comp. Composition 10 | Comp. Composition 11 | Comp. Composition 12 | Comp. Composition 13 |
|---|---|---|---|---|---|
| Combination of Additives | 0.48 | 0.48 | 0.48 | 0.48 | 0.48 |
| Composition 10 | — | — | — | — | — |
| Irgacor NPA | 0.025 | 0.03 | 0.07 | — | — |
| Irgacor L12 | — | — | — | 0.015 | 0.02 |
| ASTM D 665B | Pass | Pass | Pass | Fail | Fail |

| | Comp. Composition 14 | Comp. Composition 15 | Comp. Composition 16 |
|---|---|---|---|
| Combination of Additives | 0.48 | 0.48 | 0.48 |
| Composition 10 | — | — | — |
| Irgacor NPA | — | — | — |
| Irgacor L12 | 0.025 | 0.03 | 0.07 |
| ASTM D 665B | Fail | Fail | Pass |

*Similar Compositions at 0.01, 0.02, and 0.03 weight percent of Composition 10 that do not include any glycerol monooleate also pass Compositions 31-37 and Comparative Compositions 17-21:

Compositions 31-34 are formed according to this invention and include a Group II ISO VG 46 base oil, 0.30 wt % of a combination of additives described below, and varying amounts of Inhibitor 10. Compositions 35-37 are also formed according to this invention and include a Group III ISO VG 46 base oil, 0.30 wt % of a combination of additives described below, and varying amounts of Inhibitor 10.

Comparative Compositions 17 and 18 include the same Group II ISO VG base oil and the same 0.30 wt % of the combination of additives as Compositions 31-34. In addition, Comparative Compositions 19-21 include the same Group III ISO VG base oil and the same 0.30 wt % of the combination of additives as Compositions 35-37. However, Comparative Compositions 17 and 18 and 19-21 substitute various amounts of Irgacor L12 for Inhibitor 10. Irgacor L12 is a mixture of succinic acid partial esters.

| Combination of Additives | Approximate Parts by Weight Each of the Additives Per 100 Parts by Weight of the Combination |
|---|---|
| Phenolic Antioxidant(s) | 60 ± 5 |
| Aminic Antioxidant(s) | 20 ± 5 |
| Benzotriazole Derivative(s) (Metal Deactivator) | 20 ± 5 |

Each of Compositions 31-37 and Comparative Compositions 17-21 is applied to a steel article to reduce corrosion of that article. The steel article is evaluated according to ASTM D 665 B to determine whether any corrosion occurs and whether the article passes the test. The results of these evaluations are set forth immediately below.

| | Composition 31 | Composition 32 | Composition 33 | Composition 34 | Composition 35 |
|---|---|---|---|---|---|
| Combination of Additives | 0.30 | 0.30 | 0.30 | 0.30 | 0.30 |
| Composition 10 | 0.025 | 0.03 | 0.05 | 0.055 | 0.03 |
| Irgacor L12 | — | — | — | — | — |
| ASTM D 665B | Fail | Pass | Pass | Fail | Pass |

| | Composition 36 | Composition 37 | Comp. Composition 17 | Comp. Composition 18 |
|---|---|---|---|---|
| Combination of Additives | 0.30 | 0.30 | 0.30 | 0.30 |
| Composition 10 | 0.05 | 0.07 | — | — |

-continued

| | | | | |
|---|---|---|---|---|
| Irgacor L12 | — | — | 0.03 | 0.05 |
| ASTM D 665B | Pass | Fail | Fail | Pass |

| | Comp. Composition 19 | Comp. Composition 20 | Comp. Composition 21 |
|---|---|---|---|
| Combination of Additives | 0.30 | 0.30 | 0.30 |
| Composition 10 | — | — | — |
| Irgacor L12 | 0.03 | 0.05 | 0.07 |
| ASTM D 665B | N/A* | N/A* | N/A* |

*Irgacor L12 does not dissolve and thus Comparative Compositions 18-21 cannot be evaluated according to ASTM D 665B Compositions 38-45 and Comparative Compositions 22-26:

Compositions 38-41 are formed according to this invention and include a Group II ISO VG 46 base oil, 0.40 wt % of a combination of additives described below, 0.005 wt % of glycerol monooleate, and varying amounts of Inhibitor 10. Compositions 42-45 are also formed according to this invention and include a Group III ISO VG 46 base oil, 0.40 wt % of a combination of additives described below, 0.005 wt % of glycerol monooleate, and varying amounts of Inhibitor 10.

Comparative Compositions 22-24 include the same Group II ISO VG base oil, the same 0.40 wt % of the combination of additives, and the same 0.005 wt % of glycerol monooleate as Compositions 38-41. In addition, Comparative Compositions 25 and 26 include the same Group III ISO VG base oil and the same 0.40 wt % of the combination of additives, and the same 0.005 wt % of glycerol monooleate as Compositions 42-45. However, Comparative Compositions 22-26 substitute various amounts of Irgacor L12 for Inhibitor 10.

| Combination of Additives | Approximate Parts by Weight Each of the Additives Per 100 Parts by Weight of the Combination |
|---|---|
| Phenolic Antioxidant(s) | 24 ± 5 |
| Aminic Antioxidant(s) | 53 ± 5 |
| Solvent(s) | 15 ± 5 |
| Benzotriazole Derivative(s) (Metal Deactivator) | 8 ± 5 |

Each of Compositions 38-45 and Comparative Compositions 22-26 is applied to a steel article to reduce corrosion of that article. The steel article is evaluated according to ASTM D 665 B to determine whether any corrosion occurs and whether the article passes the test. The results of these evaluations are set forth immediately below.

| | Composition 38 | Composition 39 | Composition 40 | Composition 41 | Composition 42 |
|---|---|---|---|---|---|
| Combination of Additives | 0.40 | 0.40 | 0.40 | 0.40 | 0.40 |
| Composition 10 | 0.02 | 0.03 | 0.05 | 0.07 | 0.02 |
| Irgacor L12 | — | — | — | — | — |
| ASTM D 665B | Fail | Pass | Pass | Fail | Fail |

| | Composition 43 | Composition 44 | Composition 45 | Comp. Composition 22 | Comp. Composition 23 |
|---|---|---|---|---|---|
| Combination of Additives | 0.40 | 0.40 | 0.40 | 0.40 | 0.40 |
| Composition 10 | 0.03 | 0.05 | 0.07 | — | — |
| Irgacor L12 | — | — | — | 0.03 | 0.05 |
| ASTM D 665B | Pass | Fail | Fail | Fail | Fail |

| | Comp. Composition 24 | Comp. Composition 25 | Comp. Composition 26 |
|---|---|---|---|
| Combination of Additives | 0.40 | 0.40 | 0.40 |
| Composition 10 | — | — | — |
| Irgacor L12 | 0.07 | 0.03 | 0.07 |
| ASTM D 665B | Fail | Fail | Fail |

Compositions 46-53 and Comparative Compositions 27-32:

Compositions 46-49 are formed according to this invention and include a Group II ISO VG 46 base oil, 0.48 wt % of a combination of additives described below, 0.04 wt % of glycerol monooleate, and varying amounts of Inhibitor 10. Compositions 50-53 are also formed according to this invention and include a Group III ISO VG 46 base oil, 0.48 wt % of a combination of additives described below, 0.04 wt % of glycerol monooleate, and varying amounts of Inhibitor 10.

Comparative Compositions 27-30 include the same Group II ISO VG base oil, the same 0.48 wt % of the combination of additives, and the same 0.04 wt % of glycerol monooleate as Compositions 46-49. In addition, Comparative Compositions 31 and 32 include the same Group III ISO VG base oil and the same 0.48 wt % of the combination of additives, and the same 0.04 wt % of glycerol monooleate as Compositions 50-53. However, Comparative Compositions 27-32 substitute various amounts of Irgacor L12 for Inhibitor 10.

| Combination of Additives | Approximate Parts by Weight Each of the Additives Per 100 Parts by Weight of the Combination |
|---|---|
| Aminic and Phenolic Antioxidant(s) | 75 ± 5 |
| Anti-wear Additive(s) | 20 ± 5 |
| Metal Deactivator(s) | 8 ± 5 |
| Antifoam Additive(s) | 1 ± 0.5 |
| EO/PO Block Copolymer(s) (Demulsifier) | 0.5 ± 0.25 |

Each of Compositions 46-53 and Comparative Compositions 27-32 is applied to a steel article to reduce corrosion of that article. The steel article is evaluated according to ASTM D 665 B to determine whether any corrosion occurs and whether the article passes the test. The results of these evaluations are set forth immediately below.

ally perform as well, if not better, than commercially available materials and in many instances at the same or lower treat rates. In addition, the alkylethercarboxylic acid corrosion inhibitor(s) of this invention perform in a variety of formulations including, but not limited to, hydraulic fluids, turbine oils, R&O oils, and compressor oils.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific

| | Composition 46 | Composition 47 | Composition 48 | Composition 49 | Composition 50 |
|---|---|---|---|---|---|
| Combination of Additives | 0.48 | 0.48 | 0.48 | 0.48 | 0.48 |
| Composition 10 | 0.02* | 0.03* | 0.05* | 0.07* | 0.02 |
| Irgacor L12 | — | — | — | — | — |
| ASTM D 665B | Pass | Pass | Pass | Pass | Pass |

| | Composition 51 | Composition 52 | Composition 53 | Comp. Composition 27 | Comp. Composition 28 |
|---|---|---|---|---|---|
| Combination of Additives | 0.48 | 0.48 | 0.48 | 0.48 | 0.48 |
| Composition 10 | 0.03 | 0.05 | 0.07 | — | — |
| Irgacor L12 | — | — | — | 0.02 | 0.03 |
| ASTM D 665B | Pass | Pass | Pass | Pass | Pass |

| | Comp. Composition 29 | Comp. Composition 30 | Comp. Composition 31 | Comp. Composition 32 |
|---|---|---|---|---|
| Combination of Additives | 0.48 | 0.48 | 0.48 | 0.48 |
| Composition 10 | — | — | — | — |
| Irgacor L12 | 0.05 | 0.07 | 0.02 | 0.07 |
| ASTM D 665B | Pass | Pass | Pass | Pass |

*Similar Compositions at 0.02, 0.03, 0.05, and 0.07 weight percent of Composition 10 that do not include any glycerol monooleate also pass That data set forth in the Tables above evidence that the Compositions of this invention that include the alkylethercarboxylic acid corrosion inhibitor allow the steel article to pass ASTM D 665 B relative to corrosion. In fact, the alkylethercarboxylic acid corrosion inhibitors of this invention generembodiments within the scope of the appended claims. In addition, with respect to the language which defines or modifies a range, such as "at least," "greater than," "less than," "no more than," and the like, it is to be understood that such language includes subranges and/or an upper or lower limit.

As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A lubricant composition free of water and comprising:

a base oil present in an amount of greater than 85 parts by weight per 100 parts by weight of said lubricant composition; and one or more alkylethercarboxylic acid corrosion inhibitor (s) having the formula;

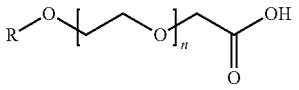

wherein R is a straight or branched chain $C_6$-$C_{18}$ alkyl group and n is a number of from about 2 to about 3, and wherein said lubricant composition comprises from 0.01 to less than 0.1 weight percent of the one or more alkylethercarboxylic acid corrosion inhibitor(s); and wherein said lubricant composition further comprises an antioxidant.

2. A lubricant composition as set forth in claim 1 wherein R is a straight or branched chain $C_{12}$-$C_{14}$ alkyl group and n is about 3.

3. A lubricant composition as set forth in claim 1 wherein said one or more alkylethercarboxylic acid corrosion inhibitor(s) are present in an amount of from about 0.02 to less than about 0.07 weight percent based on a total weight of said lubricant composition.

4. A lubricant composition as set forth in claim 1 wherein said one or more alkylethercarboxylic acid corrosion inhibitor(s) have the formula:

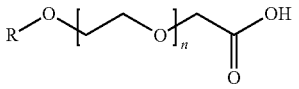

wherein R comprises a mixture of $C_{12}$ and $C_{14}$ alkyl groups and n has is about 2.5; or wherein R comprises a mixture of $C_{16}$ and $C_{18}$ alkyl groups and n is about 2.

5. A lubricant composition as set forth in claim 1 further comprising an anti-wear additive.

6. A lubricant composition as set forth in claim 5 wherein said anti-wear additive comprises phosphorous and/or sulfur.

7. A lubricant composition as set forth in claim 1 further comprising a detergent comprising calcium.

8. A lubricant composition as set forth in claim 1 wherein said base oil is further defined as an API Group I, Group II or Group III oil.

9. A lubricant composition as set forth in claim 1 wherein said base oil is further defined as a mineral or synthetic base oil or a mixture of a mineral or synthetic base oil.

10. A lubricant composition as set forth in claim 1 that reduces corrosion of a steel article such that the steel article passes corrosion testing according to ASTM D 665 B.

11. A lubricant composition as set forth in claim 1 wherein said base oil is further defined as an API Group II oil and said one or more alkylethercarboxylic acid corrosion inhibitor(s) are present in an amount of from 0.02 to 0.07 weight percent based on a total weight of said composition and wherein said lubricant composition further comprises an anti-wear component comprising first and second compounds each of which comprises phosphorous and/or sulfur, two aminic antioxidants, an alkoxylated block copolymeric demulsifier, and a benzotriazole metal deactivator.

12. A lubricant composition as set forth in claim 1 wherein said base oil is further defined as an API Group II oil and said one or more alkylethercarboxylic acid corrosion inhibitor(s) are present in an amount of from 0.02 to 0.07 weight based on a total weight of said lubricant composition, wherein said antioxidant comprises an aminic antioxidant and a phenolic antioxidant, and wherein said lubricant composition further comprises a benzotriazole metal deactivator.

13. A lubricant composition as set forth in claim 1 wherein said base oil is further defined as an API Group II oil and said one or more alkylethercarboxylic acid corrosion inhibitor(s) are present in an amount of from 0.02 to 0.07 weight percent based on a total weight of said lubricant composition, wherein said antioxidant comprises two aminic antioxidants and a phenolic antioxidant, and wherein said lubricant composition further comprises a benzotriazole metal deactivator.

14. A lubricant composition as set forth in claim 1 wherein the base oil is further defined as an API Group II or III oil, and R is a straight or branched chain $C_{12}$-$C_{14}$ alkyl group.

15. A method of reducing corrosion of a steel article, said method comprising the steps of:

A. providing a base oil;

B. providing one or more alkylethercarboxylic acid corrosion inhibitor(s) having the formula;

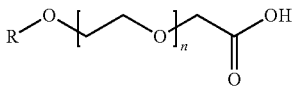

wherein R is a straight or branched chain $C_6$-$C_{18}$ alkyl group and n is a number of from about 2 to about 3;

C. combining the base oil, and the one or more alkylethercarboxylic acid corrosion inhibitor(s), and an antioxidant to form a lubricant composition comprising from 0.01 to less than 0.1 weight percent of the one or more alkylethercarboxylic acid corrosion inhibitor(s); and D. applying the lubricant composition to the steel article;

wherein the steel article passes corrosion testing according to ASTM D 665 B, and wherein the lubricant composition comprises less than 1 weight percent of water, and wherein the base oil is present in an amount of greater than 85 parts by weight per 100 parts by weight of the lubricant composition.

16. A method as set forth in claim 15 wherein R is a straight or branched chain $C_{12}$-$C_{14}$ alkyl group and n is about 3.

17. A method as set forth in claim 15 wherein the one or more alkylethercarboxylic acid corrosion inhibitor(s) are present in an amount of from about 0.02 to about less than about 0.07 weight percent based on a total weight of the lubricant composition.

18. A method as set forth in claim 15 wherein the one or more alkylethercarboxylic acid corrosion inhibitor(s) have the formula:

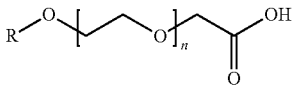

wherein R comprises a mixture of $C_{12}$ and $C_{14}$ alkyl groups and n is about 2.5; or wherein R comprises a mixture of $C_{16}$ and $C_{18}$ alkyl groups and n is about 2.

19. A method as set forth in claim 15 wherein the lubricant composition further comprises an anti-wear additive.

20. A method as set forth in claim 19 wherein the anti-wear additive comprises phosphorous and/or sulfur.

21. A method as set forth in claim 15 wherein the base oil is present in an amount of from about 80 to about 99.5 percent by weight based on a total weight of the lubricant composition.

22. A method as set forth in claim 15 wherein the base oil is further defined as an API Group I, Group II or Group III oil.

23. A lubricant composition as set forth in claim 1 wherein said one or more alkylethercarboxylic acid corrosion inhibitor(s) are present in an amount of from 0.01 to 0.07 weight percent based on a total weight of said lubricant composition.

24. A method as set forth in claim 15 wherein the one or more alkylethercarboxylic acid corrosion inhibitor(s) are present in an amount of from 0.01 to 0.07 weight percent based on a total weight of the lubricant composition.

25. A lubricant composition as set forth in claim 23 wherein n is 3.

26. A method as set forth in claim 24 wherein n is 3.

* * * * *